US012497769B2

(12) United States Patent
Okabe et al.

(10) Patent No.: US 12,497,769 B2
(45) Date of Patent: Dec. 16, 2025

(54) FLUSH TOILET APPARATUS

(71) Applicant: TOTO LTD., Fukuoka (JP)

(72) Inventors: Ryohei Okabe, Fukuoka (JP); Kenji Hatama, Fukuoka (JP); Kenji Watanabe, Fukuoka (JP); Hiroshi Hashimoto, Fukuoka (JP)

(73) Assignee: Toto Ltd., Fukuoka (JP)

( * ) Notice: Subject to any disclaimer, the term of this patent is extended or adjusted under 35 U.S.C. 154(b) by 44 days.

(21) Appl. No.: 18/779,335

(22) Filed: Jul. 22, 2024

(65) Prior Publication Data

US 2025/0043556 A1 Feb. 6, 2025

(30) Foreign Application Priority Data

Jul. 31, 2023 (JP) ..... 2023-124564

(51) Int. Cl.
*E03D 1/26* (2006.01)

(52) U.S. Cl.
CPC ..... *E03D 1/26* (2013.01)

(58) Field of Classification Search
CPC ..... E03D 1/26; E03D 1/00–38; E03D 11/13; E03D 11/00
See application file for complete search history.

(56) References Cited

U.S. PATENT DOCUMENTS

| | | | | |
|---|---|---|---|---|
| 2,562,330 | A * | 7/1951 | Peterson | E03D 1/01 4/416 |
| 10,385,559 | B2 | 8/2019 | Canfield et al. | |
| 2004/0064879 | A1 | 4/2004 | Hand | |
| 2021/0372108 | A1 | 12/2021 | Matsunaka et al. | |

FOREIGN PATENT DOCUMENTS

| | | | |
|---|---|---|---|
| CN | 115538541 | A | 12/2022 |
| EP | 2128351 | A2 | 12/2009 |
| EP | 3321433 | A1 | 5/2018 |
| JP | H03-046584 | U | 4/1991 |
| JP | 2004-332451 | A | 11/2004 |
| JP | 2010007451 | A | 1/2010 |
| JP | 2018-529035 | A | 10/2018 |

OTHER PUBLICATIONS

Decision to Grant a Patent issued on Jun. 19, 2025 (with an English translation).

* cited by examiner

*Primary Examiner* — Erin Deery
(74) *Attorney, Agent, or Firm* — BakerHostetler

(57) ABSTRACT

The present invention provides a flush toilet apparatus that includes a flush toilet main body, and a flush water tank that is fixed via at least two fixing points and causes flush water to flow into a water inlet of the flush toilet main body, in which the water inlet is provided at a position eccentric to one side with respect to a lengthwise center line of the flush toilet main body, two of fixing points are each disposed on both sides of the discharge port, and are disposed so that a straight line connecting the two fixing points passes through the discharge port in a top view, and the fixing point located on a rear side among the two fixing points is located closer to the lengthwise center line of the flush toilet main body than a center point of the discharge port.

8 Claims, 6 Drawing Sheets

FLUSH TOILET APPARATUS

CROSS-REFERENCE TO RELATED APPLICATIONS

This application claims the benefit of Japanese Patent Application No. 2023-124564 filed on Jul. 31, 2023, which is hereby incorporated by reference in its entirety for all purposes as if fully set forth herein.

BACKGROUND OF THE INVENTION

Field of the Invention

The present invention relates to a flush toilet apparatus, and more particularly, to a flush toilet apparatus for flushing with flush water stored in a flush water tank.

Description of the Related Art

A reservoir tank and a flush toilet provided therewith are described in Japanese Patent Laid-Open No. 2010-7451 (Patent Literature 1). In this flush toilet, the reservoir tank is disposed on a rear portion of a flush toilet main body, and a bowl of the flush toilet main body is flushed with flush water discharged from the reservoir tank. In the reservoir tank, a tank discharge port is provided at a center of the reservoir tank in a width direction, and the flush water in the reservoir tank flows into the flush toilet main body through a tank connecting hole to flush the bowl, the tank connecting hole being provided at a center of the flush toilet main body in a width direction and located directly below the tank discharge port.

However, a water discharge trap pipe extending rearward from the bowl extends to the center of the rear portion of the flush toilet main body in the width direction. This makes it necessary to provide, on an upper side of the water discharge trap pipe, a flush water flow path that extends from the tank connecting hole in the flush toilet main body and into which the flush water in the reservoir tank flows, because otherwise the flow path extending from the tank connecting hole overlaps with a position of the water discharge trap pipe. As a result, the flow path extending from the tank connecting hole needs to be provided at a higher position, thus making it difficult to achieve a "low silhouette" of the flush toilet apparatus.

Accordingly, the present invention has an object to provide a flush toilet apparatus that can achieve a low silhouette while a flush water tank is disposed at a rear portion of a flush toilet main body.

SUMMARY OF THE INVENTION

To solve the problems described above, the present invention provides a flush toilet apparatus for flushing with flush water stored in a flush water tank, the flush toilet apparatus comprising: a flush toilet main body that includes a bowl and a water discharge trap pipe extending from the bowl; and a flush water tank that is fixed to a rear portion of the flush toilet main body via at least two fixing points and drains the stored flush water from a discharge port to cause the flush water to flow into a water inlet of the flush toilet main body, wherein the water inlet of the flush toilet main body is provided at a position eccentric to one side with respect to a lengthwise center line of the flush toilet main body, wherein two fixing points among the fixing points are each disposed on both sides of the discharge port in a longitudinal direction of the flush toilet main body, and are disposed so that a straight line connecting the two fixing points passes through the discharge port in a top view, and wherein the fixing point located on a rear side among the two fixing points is located closer to the lengthwise center line of the flush toilet main body than a center point of the discharge port.

According to the present invention thus constituted, the water inlet of the flush toilet main body is provided at a position eccentric to one side with respect to a lengthwise center line of the flush toilet main body, thereby making it possible to provide the water inlet of the flush toilet main body while avoiding the water discharge trap pipe extending from the bowl. As a result, the water inlet can be formed at a lower position, and a low-silhouette flush toilet apparatus can be achieved. The straight line connecting the two fixing points passes through the discharge port in a top view, thereby making it possible to firmly define a position of the flush water tank in the vicinity of the discharge port. This can prevent the water leakage between the discharge port of the flush water tank and the water inlet of the flush toilet main body. Furthermore, the two fixing points are each disposed on both sides of the discharge port in the longitudinal direction of the flush toilet main body, and the fixing point on the rear side is located closer to the lengthwise center line of the flush toilet main body than the center point of the discharge port. This makes it possible to firmly fix the flush water tank to the flush toilet main body, and to sufficiently resist a force that tends to knock down the flush water tank in the longitudinal direction of the flush toilet main body.

In the present invention, it is preferable that the flush toilet apparatus further comprises a packing for ensuring watertightness between the flush toilet main body and the flush water tank, wherein the packing is disposed between the flush toilet main body and the flush water tank, and is compressed by fixing the flush water tank to the flush toilet main body at the two fixing points.

According to the present invention thus constituted, the packing is disposed between the flush toilet main body and the flush water tank, and the packing is compressed by fixing the flush water tank. Therefore, the two fixing points are disposed so that the straight line connecting the two fixing points passes through the discharge port, thereby making it possible to uniformly compress the packing, and to increase the watertightness between the flush toilet main body and the flush water tank.

In the present invention, it is preferable that the water inlet of the flush toilet main body is provided at a position lower than a rim upper surface of the flush toilet main body and higher than a pooled water level in the bowl of the flush toilet main body.

According to the present invention thus constituted, the water inlet of the flush toilet main body is lower than the rim upper surface of the flush toilet main body, thereby making it possible to achieve the low-silhouette flush toilet apparatus. Furthermore, the water inlet of the flush toilet main body is higher than the pooled water level in the bowl of the flush toilet main body, thereby making it possible to prevent the water inlet of the flush toilet main body from being immersed in the water during a non-flushing period of the flush toilet apparatus, and to reduce the deterioration of the packing.

In the present invention, it is preferable that at least one auxiliary fixing point for fixing the flush water tank to the flush toilet main body is further provided on a side opposite to the water inlet of the flush toilet main body with respect to the lengthwise center line of the flush toilet main body.

According to the present invention thus constituted, the auxiliary fixing points are provided on a side opposite to the water inlet of the flush toilet main body with respect to the lengthwise center line of the flush toilet main body, thereby making it possible to sufficiently resist a force that tends to knock down the flush water tank in the width direction, and to firmly fix the flush water tank.

In the present invention, it is preferable that at least two of the auxiliary fixing points are provided, and at least one of the auxiliary fixing points are provided at a position higher than the water inlet.

According to the present invention thus constituted, at least one of the auxiliary fixing points is provided at a position higher than the water inlet, thereby making it possible to fix the flush water tank at a higher position, to more strongly resist the force that tends to knock down the flush water tank when the force acts on the upper portion of the flush water tank, and to firmly fix the flush water tank.

In the present invention, it is preferable that the flush water tank includes a flush water tank main body and a base plate, and the base plate is fixed to the flush toilet main body via the plurality of fixing points and auxiliary fixing points.

According to the present invention thus constituted, the base plate constituting a part of the flush water tank is fixed to the flush toilet main body via the plurality of fixing points and auxiliary fixing points, thereby making it possible to cause the base plate to absorb position errors of the fixing points formed in the flush toilet main body, and to attach the flush water tank main body in an appropriate position.

In the present invention, it is preferable that the flush toilet apparatus further comprises a radial sealing member disposed between the flush water tank main body and the base plate, the radial sealing member making it possible to ensure watertightness between the flush water tank main body and the base plate.

According to the present invention thus constituted, the radial sealing member is disposed between the flush water tank main body and the base plate, thereby making it possible to ensure the watertightness between the flush water tank main body and the base plate. The watertightness is ensured by the radial sealing member, thereby making it possible to achieve the low-silhouette flush toilet apparatus in which a seal portion is provided with a thinner thickness compared to a case where a face seal is disposed between the flush water tank main body and the base plate.

In the present invention, it is preferable that the water discharge trap pipe extends from the bowl to below the flush water tank, and the auxiliary fixing points are located on an opposite side of the water inlet of the flush toilet main body with respect to the water discharge trap pipe.

According to the present invention thus constituted, the flush water tank is fixed by the fixing points provided on the water inlet side of the flush toilet main body and the auxiliary fixing points provided on the opposite side of the water inlet, with respect to the water discharge trap pipe, thereby making it possible to firmly fix the flush water tank with a good balance.

According to the flush toilet apparatus of the present invention, a low silhouette can be achieved while disposing the flush water tank at the rear portion of the flush toilet main body.

DETAILED DESCRIPTION OF THE PREFERRED EMBODIMENTS

Next, a flush toilet apparatus according to an embodiment of the present invention will be described with reference to the accompanying drawings.

Figure 1:
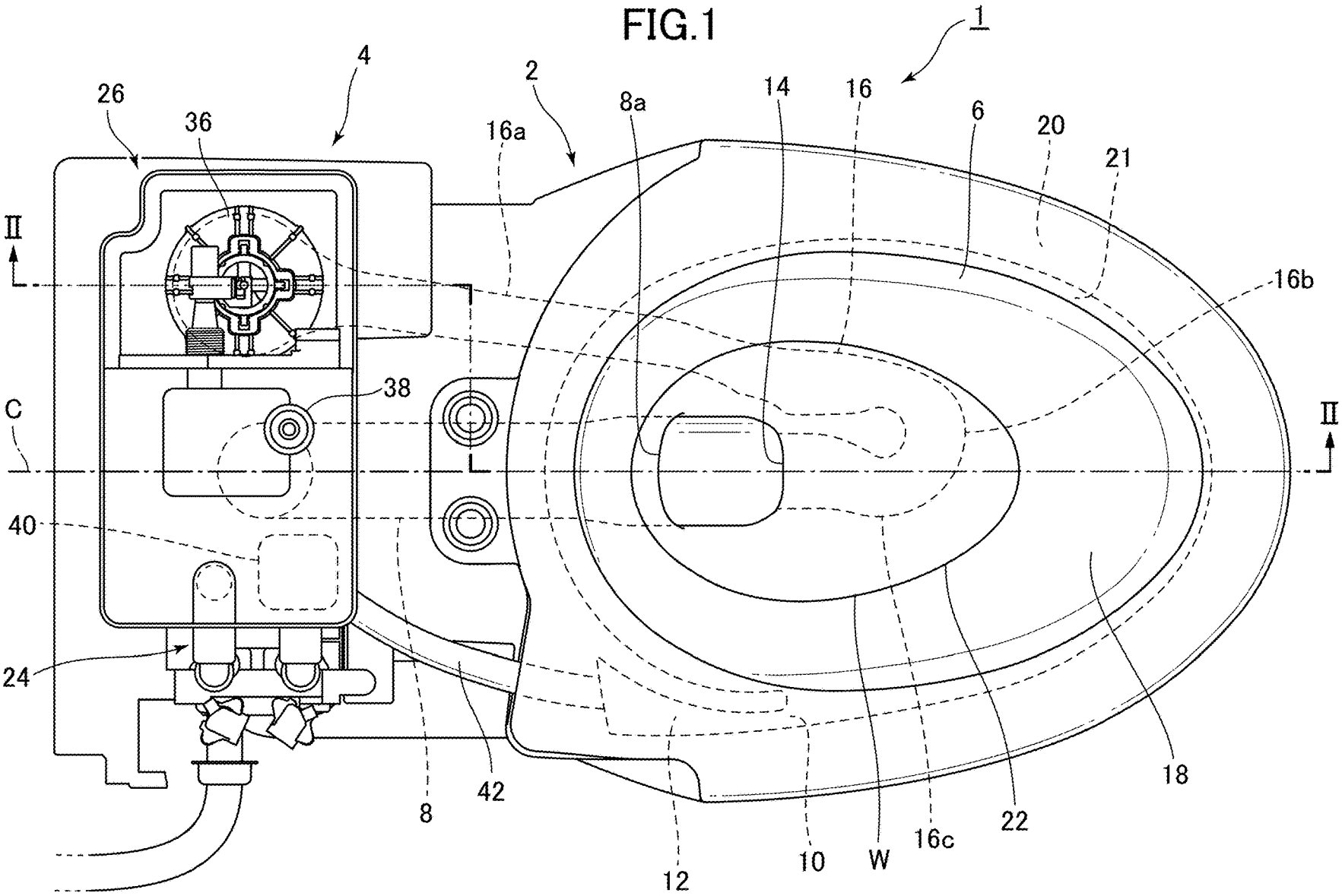
FIG. 1 is a plan view illustrating a flush toilet apparatus according to an embodiment of the present invention.
Figure 2:
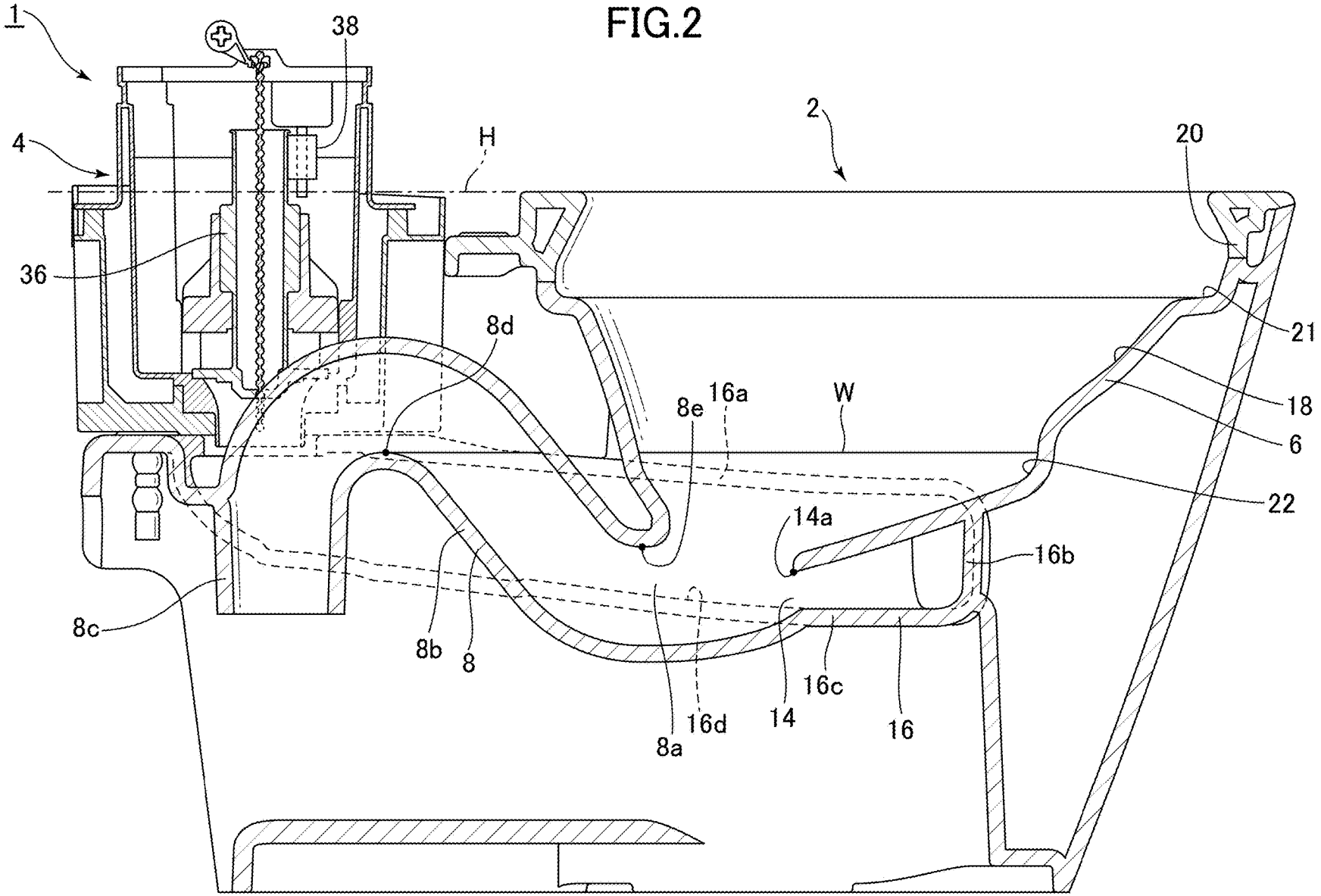
FIG. 2 is a sectional side view taken along line II-II in FIG. 1, in the flush toilet apparatus according to an embodiment of the present invention.

FIG. 1 is a plan view illustrating a flush toilet apparatus according to an embodiment of the present invention. FIG. 2 is a cross-sectional view taken along line II-II in FIG. 1.

As illustrated in FIGS. 1 and 2, a flush toilet apparatus 1 according to an embodiment of the present invention is a siphon jet flush toilet, and includes a flush toilet main body 2 made of ceramics, a toilet seat and toilet lid (not illustrated) made of resin that are disposed on an upper surface of the flush toilet main body 2, and a flush water supply device 4 that is disposed at a rear upper portion of the flush toilet main body 2 and is covered with a cover (not illustrated) made of resin.

The flush toilet main body 2 is formed with a bowl 6 for receiving waste, a water discharge trap pipe 8 provided at a bottom of the bowl 6 for discharging waste by a siphon effect, a rim spout port 10 for rim spouting, a rim conduit 12 for guiding flush water to the rim spout port, a jet spout port 14 for jet spouting, and a jet water conduit 16 for guiding flush water to the jet spout port 14.

The bowl 6 includes a bowl-shaped waste receiving surface 18, a rim 20 formed along an upper edge of the bowl 6, and a shelf 21 formed between the waste receiving surface 18 and the rim 20. The bowl 6 includes a well portion 22 that is formed in a region below the waste receiving surface 18 and is connected to the water discharge trap pipe 8. A water sealing surface W is formed inside the well portion 22.

The water discharge trap pipe 8 includes an inlet 8*a*, an ascending conduit 8*b* extending upward from the inlet 8*a*, a descending conduit 8*c* extending downward from the ascending conduit 8*b*, and a top portion 8*d* that is located between the descending conduit 8*c* and the ascending conduit 8*b* to define a sealing water level.

Here, a lower end of the descending conduit 8*c* of the water discharge trap pipe 8 is connected to a water discharge conduit (not illustrated) via a discharge socket (not illustrated).

The rim spout port 10 is formed on a left rear side of the rim 20 when the flush toilet main body 2 is seen from the front. The rim spout port 10 spouts flush water forward, and the flush water circulates over an inner circumferential surface of the rim 20 and a shelf surface of the shelf 21 while flowing downward to the waste receiving surface 18.

The rim conduit 12 is formed into a tapered shape in which a cross section area of the flow path is gradually reduced toward the rim spout port 10. The flush water is supplied from the waterworks to the rim conduit 12 via the flush water supply device 4, and is then spouted from the rim spout port 10 at water supply pressure from the waterworks.

The jet spout port 14 is formed at the bottom of the bowl 6. The jet spout port 14 is disposed to face the inlet 8*a* of the water discharge trap pipe 8, and is directed toward the inlet 8*a* of the water discharge trap pipe 8. The jet spout port 14 spouts flash water toward the inlet 8*a* of the water discharge trap pipe 8, and the flush water flows into the water discharge trap pipe 8 to cause a siphon effect.

The jet water conduit 16 includes an upstream flow path 16*a* extending forward from the flush water supply device 4, a bending flow path 16*b* bending from the upstream flow path, and a downstream flow path 16*c* extending rearward from the bending flow path to be connected to the jet spout port 14. The flush water is supplied from the flush water tank 26 (FIG. 3) of the flush water supply device 4 to the jet water conduit 16, and is then spouted from the jet spout port 14 at flush water head pressure.

Next, with renewed reference to FIGS. 3 to 6, a flush water supply system provided in the flush toilet apparatus 1 of an embodiment of the present invention will be described.

Figure 3:
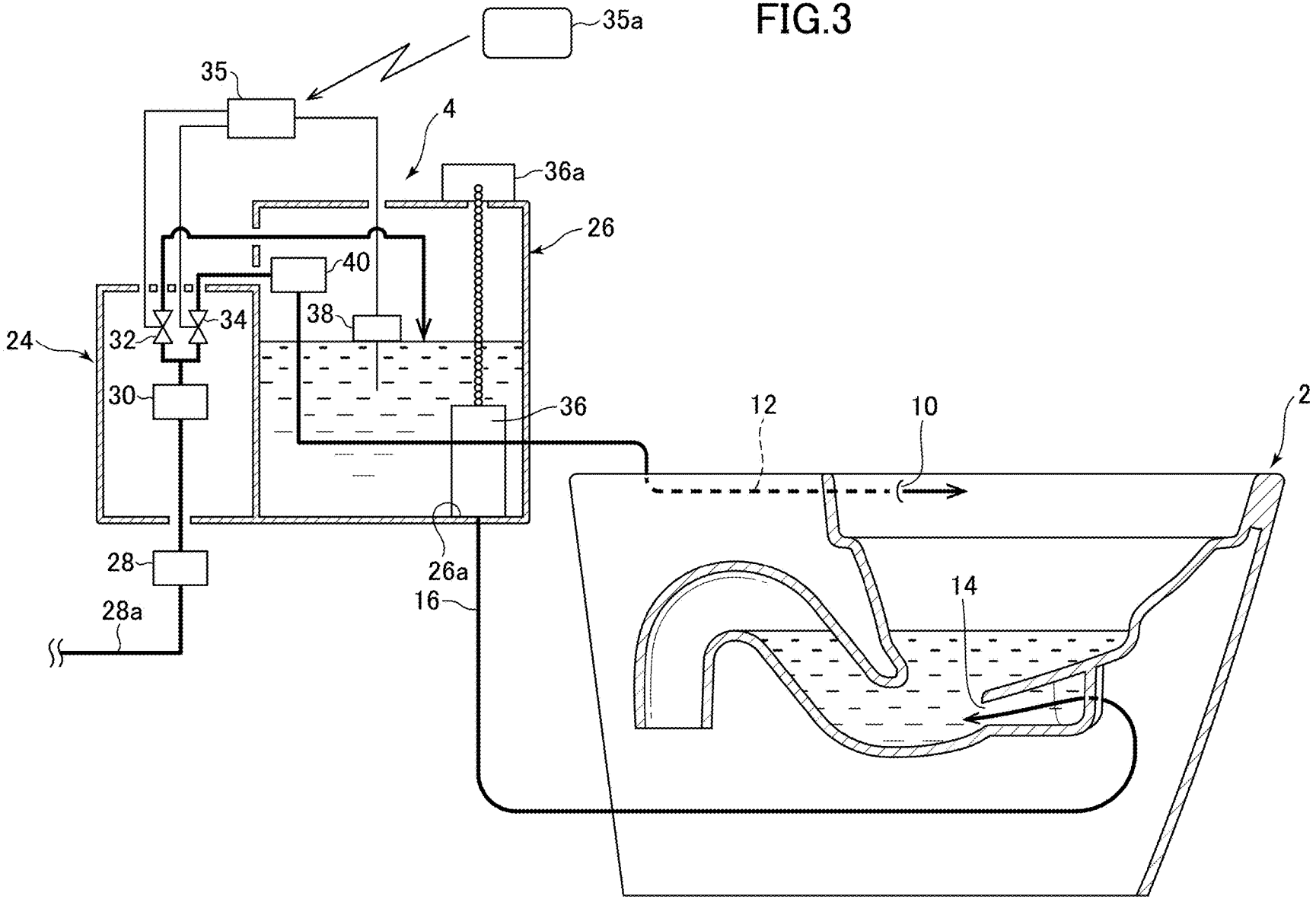
FIG. 3 is a block diagram illustrating a flush water supply system in the flush toilet apparatus of an embodiment of the present invention.
Figure 4:
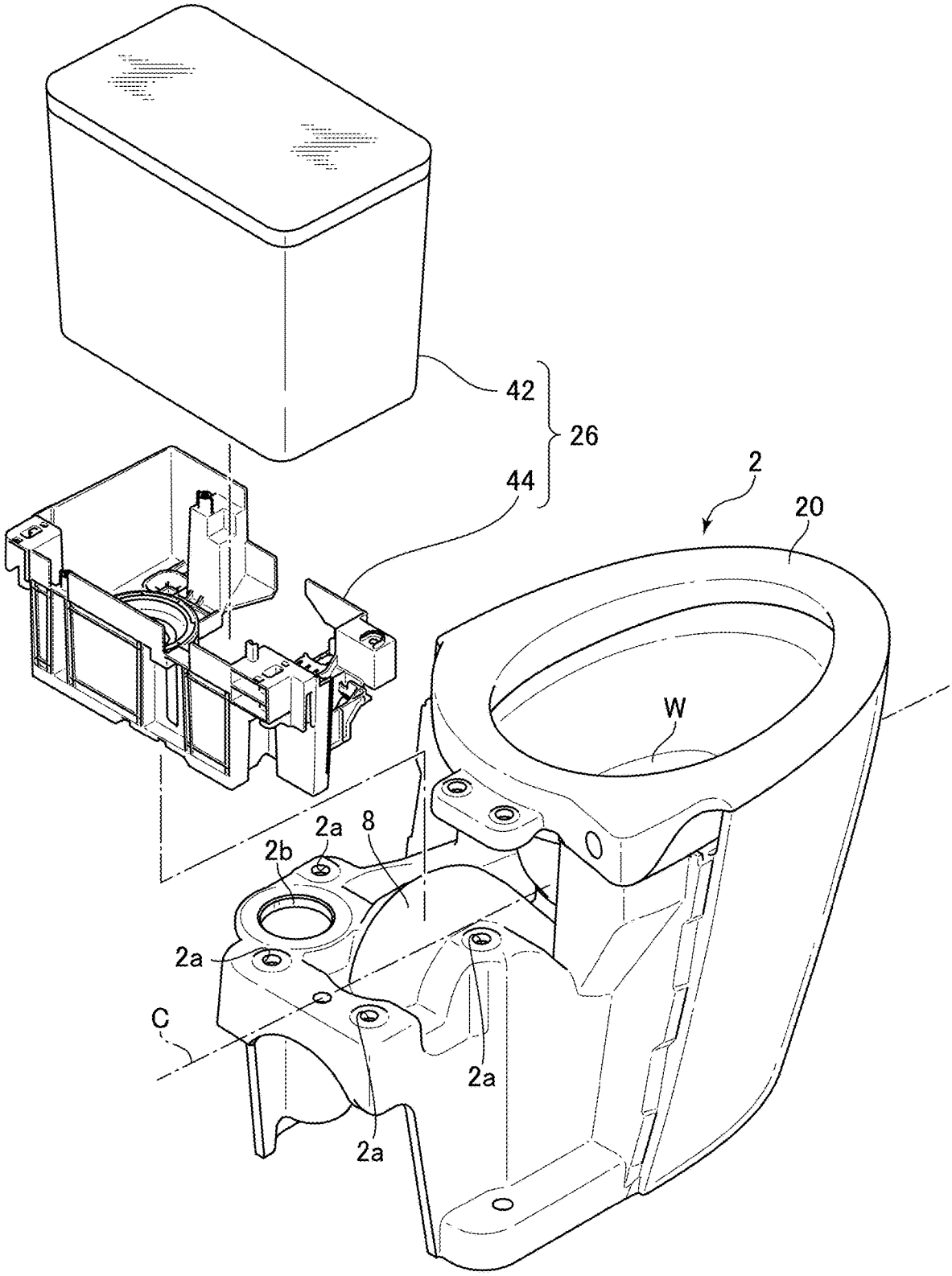
FIG. 4 is an exploded perspective view illustrating a disassembled state of the flush toilet main body and a flush water tank that are provided in the flush toilet apparatus of an embodiment of the present invention.
Figure 5:
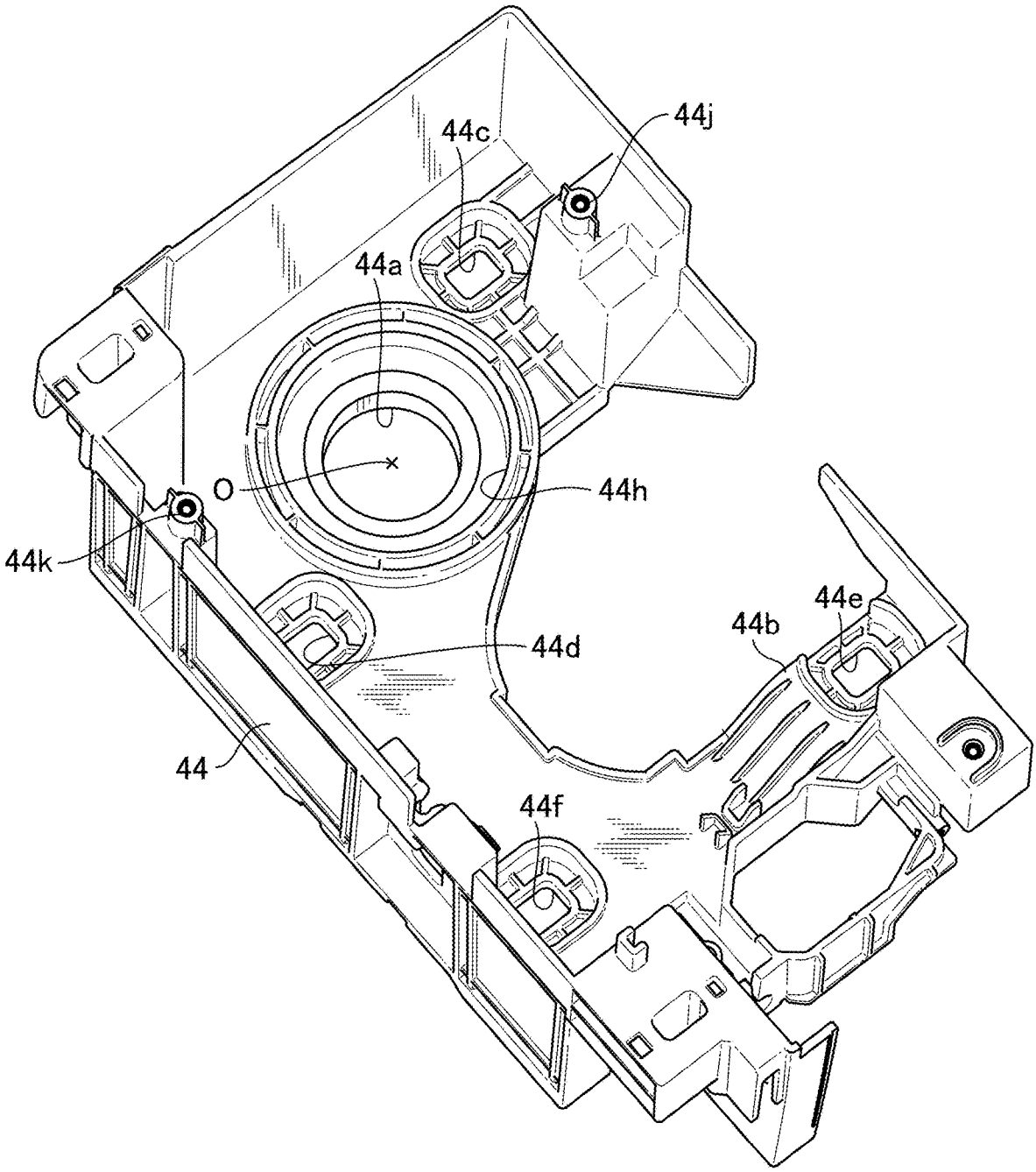
FIG. 5 is a perspective view illustrating a base plate constituting a part of the flush water tank provided in the flush toilet apparatus of an embodiment of the present invention.
Figure 6:
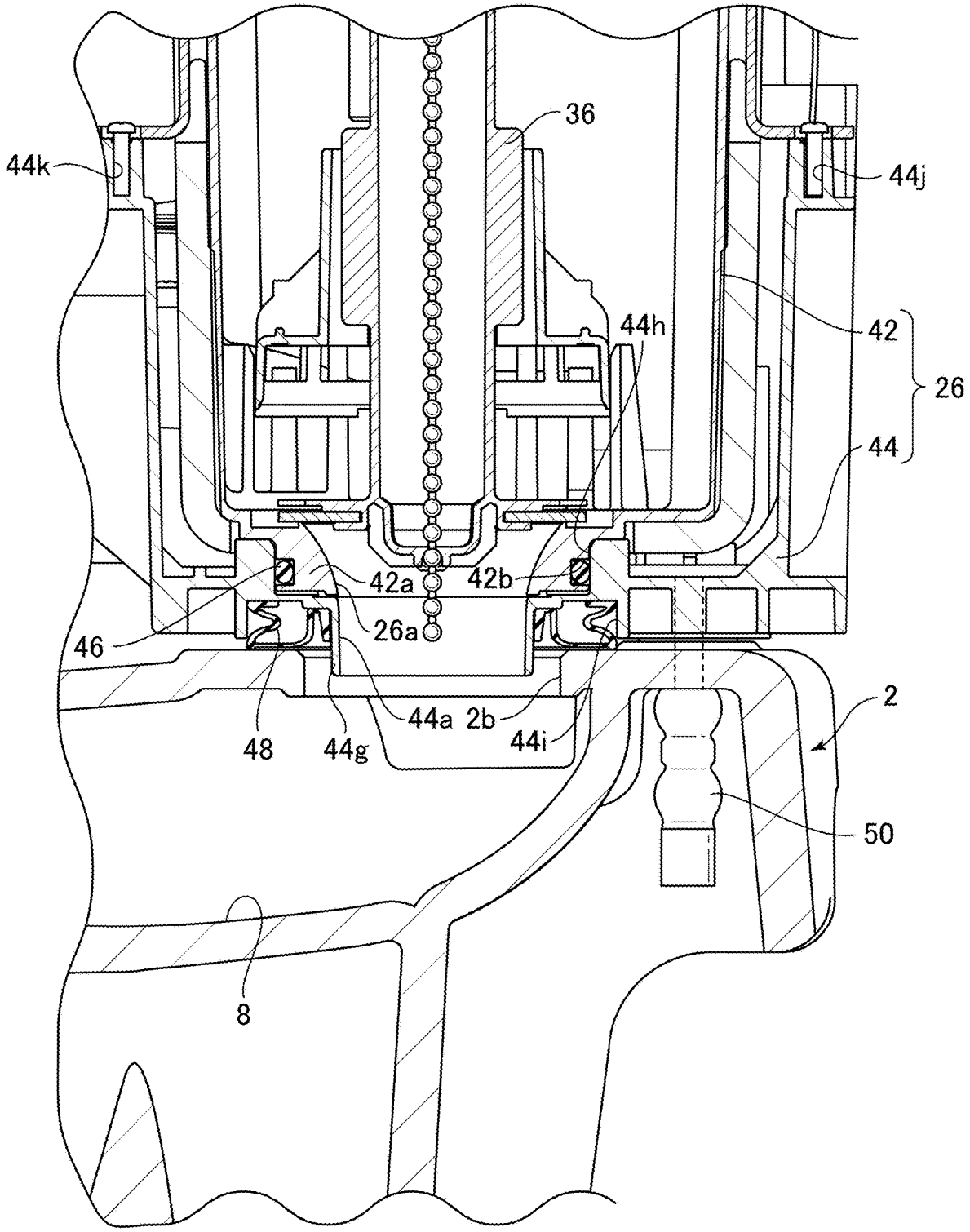
FIG. 6 is an enlarged sectional view illustrating a connecting portion of the flush toilet main body and the flush water tank in the flush toilet apparatus of an embodiment of the present invention.

FIG. 3 is a block diagram illustrating the flush water supply system in the flush toilet apparatus 1 of an embodiment of the present invention. FIG. 4 is an exploded perspective view illustrating a disassembled state of the flush toilet main body and the flush water tank that are provided in the flush toilet apparatus 1 of the present embodiment. FIG. 5 is a perspective view illustrating a base plate constituting a part of the flush water tank provided in the flush toilet apparatus 1 of the present embodiment. FIG. 6 is an enlarged sectional view illustrating a connecting portion of the flush toilet main body and the flush water tank in the flush toilet apparatus 1 of the present embodiment.

As illustrated in FIG. 3, the flush water supply device 4 includes a valve unit 24 that performs supply and stop of the flush water from the waterworks, and the flush water tank 26 made of resin that stores flush water supplied via the valve unit 24.

The valve unit 24 incorporates a fixed flow valve 30, a tank water supply electromagnetic valve 32, a rim spouting electromagnetic valve 34, and a controller 35 for controlling the tank water supply electromagnetic valve 32 and the rim spouting electromagnetic valve 34. The flush water tank 26 includes a discharge valve 36, a float switch 38, and a vacuum breaker 40.

In the present embodiment, the flush water tank 26 is a small tank made of resin that has a capacity of about 2 liters. A lower portion of the flush water tank 26 is disposed below an upper surface of the rim 20 of the flush toilet main body 2 and above the top portion 8*d* of the water discharge trap pipe 8. In this way, the flush toilet apparatus 1 becomes a low silhouette type toilet. In the present embodiment, the flush water in the flush water tank 26 is spouted from the jet spout port 14 by gravity.

A stop cock 28 is configured to cause water supplied from a waterworks conduit 28*a* to stop flowing at the time of maintenance or the like, and tap water that has passed though the stop cock 28 flows into the valve unit 24 as the flush water. Accordingly, the stop cock 28 is used in an "open" state during a normal use.

The fixed flow valve 30 is provided on the downstream of the stop cock 28, and is configured to adjust the water supplied from the waterworks to flow out at a predetermined flow rate. The water that has flowed out from the fixed flow valve 30 is branched to flow into the tank water supply electromagnetic valve 32 and the rim spouting electromagnetic valve 34.

The tank water supply electromagnetic valve 32 is opened or closed on the basis of the user's flushing operation, and the flush water that has flowed out of the tank water supply electromagnetic valve 32 flows into and is stored in the flush water tank 26.

The rim spouting electromagnetic valve 34 is opened or closed on the basis of the user's flushing operation, and the flush water that has flowed out of the rim spouting electromagnetic valve 34 is spouted from the rim spout port 10 of the flush toilet main body 2 via the rim conduit 12.

In this way, the valve unit 24 including the tank water supply electromagnetic valve 32 and the rim spouting electromagnetic valve 34 is configured to perform supply and stop of the flush water to the flush water tank 26 and perform supply and stop of the flush water to the flush toilet main body 2.

The controller 35 is configured to control opening or closing of the tank water supply electromagnetic valve 32 and the rim spouting electromagnetic valve 34 upon reception of a control signal from a remote controller 35*a* operated by a user. The controller 35 is also configured to control the tank water supply electromagnetic valve 32 on the basis of a detection signal from the float switch 38.

The discharge valve 36 is provided on a bottom surface of the flush water tank 26, and is opened on the basis of the user's flushing operation to spout the flush water stored in the flush water tank 26 from the rim spout port 10 via the jet water conduit 16. The discharge valve 36 is also configured to open a discharge port 26*a* when being pulled up from the discharge port 26*a* by a toilet flushing motor 36*a* provided in an upper portion of the flush water tank 26. The toilet flushing motor 36*a* is configured to pull up the discharge valve 36 at a predetermined timing on the basis of a control signal from the controller 35 during a toilet flush.

The float switch 38 is configured to detect a water level in the flush water tank 26, and is configured to detect that the water level in the flush water tank 26 has reached a predetermined water storage level and send the detection signal to the controller 35.

The vacuum breaker 40 is disposed, in the flush water tank 26, above the predetermined water storage level and is provided on the downstream of the rim spouting electromagnetic valve 34 and on the upstream of the rim conduit 12. This causes atmospheric air to be introduced from the vacuum breaker 40 in the case where the rim spouting electromagnetic valve 34 side is brought into a negative pressure, thereby preventing the flush water from flowing backward from the rim spout port 10 to the rim spouting electromagnetic valve 34. In the case where the flush water flows backward from the rim spout port 10, the flush water that has flowed backward flows out of the vacuum breaker 40 and flows into the flush water tank 26.

Next, a structure for attaching the flush water tank will be described with reference to FIGS. 4 to 6.

As illustrated in FIG. 4, the flush water tank 26 is disposed on an upper surface of a rear portion of the flush toilet main body 2. The flush water tank 26 includes a flush water tank main body 42, and a base plate 44 for fixing the flush water tank main body 42 to the flush toilet main body 2.

The base plate 44 is attached to the flush water tank main body 42 to surround a lower portion of the flush water tank main body 42. On the other hand, four bolt holes 2*a* are provided on the upper surface of the rear portion of the flush toilet main body 2. The base plate 44 is fixed to the flush toilet main body 2 by fastening a bolt 50 (FIG. 6) through each of these bolt holes 2*a*. The flush water tank 26 is fixed to the flush toilet main body 2 by fixing the flush water tank main body 42 to the base plate 44 fixed to the flush toilet main body 2. That is, the base plate 44 is provided with tank fixing portions 44*j* and 44*k*, and the flush water tank main body 42 of the flush water tank 26 is fixed to the base plate 44 via the tank fixing portions 44*j* and 44*k*. These tank fixing portions 44*k* and 44*j* are provided on both sides of a discharge opening 44*a* in the vicinity of the fixing holes 44*c* and 44*d* in a top view. In this way, the flush water tank 26 is fixed to the flush toilet main body 2 via the base plate 44.

Furthermore, a water inlet 2*b* is formed on the upper surface of the rear portion of the flush toilet main body 2. The water inlet 2*b* communicates with the jet water conduit 16 formed inside the flush toilet main body 2, and the flush water that has flowed from the water inlet 2*b* is spouted from the jet spout port through the jet water conduit 16. The water inlet 2*b* is provided at a position eccentric to one side with respect to a lengthwise center line C of the flush toilet main body 2, and in the present embodiment, at a position eccentric to the right side with respect to the center line C. Note that the water discharge trap pipe 8 is provided on the lengthwise center line C of the flush toilet main body 2, and an upper portion of the water discharge trap pipe 8 protrudes from the upper surface of the rear portion of the flush toilet main body 2. That is, the water discharge trap pipe 8 extends from the bowl 6 toward a lower portion of the flush water tank 26, and the water inlet 2*b* is provided eccentrically on the right side of the flush toilet main body 2 in the width direction to avoid the water discharge trap pipe 8.

The water inlet 2*b* is located directly below the discharge port 26*a* (FIG. 3) of the flush water tank 26 in a state in which the flush water tank 26 is fixed to the flush toilet main body 2, and the flush water drained from the discharge port 26*a* flows directly into the jet water conduit 16 through the water inlet 2*b*. That is, the flush water tank 26 drains the stored flush water from the discharge port 26*a* to cause the drained flush water to flow into the water inlet 2*b* of the flush toilet main body 2. Furthermore, on the upper surface of the rear portion of the flush toilet main body 2, the water inlet 2*b* is provided at a position lower than a rim upper surface (height H of the upper end surface of the rim 20 (FIG. 2)) and higher than a pooled water level (height of the water sealing surface W) in the bowl 6. Therefore, the water inlet 2*b* is not soaked in the flush water in a state in which the toilet flushing is not performed in the flush toilet apparatus 1.

Next, as illustrated in FIGS. 4 and 5, the base plate 44 is a box-shaped member made of resin as a whole, and is configured to receive a lower portion of the flush water tank main body 42 from above. The bottom surface of the base plate 44 is provided with the circular discharge opening 44*a* that is provided at a position aligned with the discharge port 26*a* of the flush water tank 26, and a cutout portion 44*b* that is provided to avoid the water discharge trap pipe 8 projecting from the upper surface of the rear portion of the flush toilet main body 2.

The bottom surface of the base plate 44 is further provided with the fixing holes 44*c* and 44*d* serving as fixing points and auxiliary fixing holes 44*e* and 44*f* serving as auxiliary fixing points. These fixing holes 44*c* and 44*d* and auxiliary fixing holes 44*e* and 44*f* are aligned with the respective positions for the four bolt holes 2*a* provided in the flush toilet main body 2. That is, the bolt 50 (FIG. 6) is inserted into each of the fixing holes 44*c* and 44*d* and the auxiliary fixing holes 44*e* and 44*f* to be fixed to each corresponding bolt hole 2*a* of the flush toilet main body 2, so that the base plate 44 can be attached to the flush toilet main body 2.

Then, positions for the fixing holes 44*c* and 44*d* of the base plate 44 and the bolt holes 2*a* corresponding to these fixing holes serve as the fixing points, and positions for the auxiliary fixing holes 44*e* and 44*f* and the bolt holes 2*a* corresponding to these auxiliary fixing holes serve as the auxiliary fixing points. That is, in the present embodiment, the base plate 44 is attached to the upper surface of the rear portion of the flush toilet main body 2 at the two fixing points (positions of the fixing holes 44*c* and 44*d*) and the two auxiliary fixing points (positions of the auxiliary fixing holes 44*e* and 44*f*).

Here, the fixing holes 44*c* and 44*d* serving as the fixing points are provided on the right side of the flush toilet main body 2 in the width direction and are each disposed on both sides of the flush toilet main body 2 in the longitudinal direction with respect to the discharge port 26*a* (discharge opening 44*a*). The two fixing holes 44*c* and 44*d* are disposed so that a straight line connecting their center points passes through the discharge port 26*a* (discharge opening 44*a*) in a top view. Furthermore, the fixing hole 44*d* located on the rear side among the two fixing holes 44*c* and 44*d* is located closer to the lengthwise center line of the flush toilet main body 2 than a center point O of the discharge port 26*a* (discharge opening 44*a*).

On the other hand, the auxiliary fixing holes 44*e* and 44*f* serving as the auxiliary fixing points are provided on the side (left side with respect to the center line C in the present embodiment) opposite to the water inlet 2*b* of the flush toilet main body 2 with respect to the lengthwise center line C of the flush toilet main body 2. That is, the auxiliary fixing holes 44*e* and 44*f* (auxiliary fixing points) are located on the side opposite to the water inlet 2*b* of the flush toilet main body 2 across the water discharge trap pipe 8. The bottom surface of the base plate 44 is configured such that a left front portion thereof is higher than the remaining portion, and the auxiliary fixing hole 44*e* provided in the higher portion in the bottom surface of the base plate 44 is provided at a position higher than the water inlet 2*b* of the flush toilet main body 2.

That is, as illustrated in FIG. 4, the two bolt holes 2*a* provided on the right side of the flush toilet main body 2 and the bolt hole 2*a* provided on the left rear side among the four bolt holes 2*a* of the flush toilet main body 2 are provided at substantially the same height as the water inlet 2*b* of the flush toilet main body 2. In contrast, the bolt hole 2*a* provided on the left front side of the flush toilet main body 2 is provided at a position higher than the other three bolt holes 2*a*. Therefore, the auxiliary fixing hole 44*e* on the front side among the two auxiliary fixing holes 44*e* and 44*f* provided in the base plate 44 is provided at the position higher than the water inlet 2*b* of the flush toilet main body 2.

Next, a structure for attaching the flush water tank 26 to the flush toilet main body 2 will be described with reference to FIG. 6.

As illustrated in FIG. 6, the bottom surface of the flush water tank main body 42 constituting the flush water tank 26 is provided with an annular protrusion 42*a* protruding downward, and the inside of the annular protrusion 42*a* forms the discharge port 26*a* of the flush water tank 26. A diameter of the discharge port 26*a* is formed to be substantially the same diameter as the discharge opening 44*a* formed in the base plate 44, and the discharge port 26*a* and the discharge opening 44*a* are smoothly connected to each other. A groove

42*b* is formed on an outer circumferential surface of the protrusion 42*a*, and an annular O ring 46 which is a radial sealing member is fitted into the groove 42*b*.

On the other hand, on the bottom surface of the base plate 44, a cylindrical portion 44*g* protruding downward is provided to surround the discharge opening 44*a*. On an upper surface of the bottom surface of the base plate 44, an annular upper surface recess 44*h* is formed to surround the discharge opening 44*a*. On the other hand, on a lower surface of the bottom surface of the base plate 44, an annular lower surface recess 44*i* is formed to surround the cylindrical portion 44*g*.

Furthermore, the protrusion 42*a* protruding from the bottom surface of the flush water tank main body 42 is received in the upper surface recess 44*h* formed in the upper surface of the base plate 44. In this way, when the protrusion 42*a* of the flush water tank main body 42 is fitted into the upper surface recess 44*h* of the base plate 44, the O ring 46 disposed on the outer circumference of the protrusion 42*a* is crushed in a radial direction of the discharge port 26*a*, thereby sealing between the flush water tank main body 42 and the base plate 44. In this specification, a sealing member that is crushed in the radial direction for sealing is referred to as a "radial sealing member."

On the other hand, a packing 48 is disposed in the annular lower surface recess 44*i* formed in the lower surface of the base plate 44. The packing 48 is formed into an annular shape as a whole, and is fitted around the cylindrical portion 44*g* formed in the inner circumference of the lower surface recess 44*i* and received in the lower surface recess 44*i*. The base plate 44 is fixed to the upper surface of the rear portion of the flush toilet main body 2 by fixing the bolt 50 (FIG. 6) to each corresponding bolt hole 2*a* (FIG. 4) of the flush toilet main body 2 through the fixing hole 44*c* and 44*d* (FIG. 5) provided in the base plate 44. At this time, the packing 48 disposed in the lower surface recess 44*i* on the lower surface of the base plate 44 is compressed between the base plate 44 and the flush toilet main body 2. That is, in the state in which the flush water tank 26 is fixed to the flush toilet main body 2, the packing 48 is crushed by being sandwiched between the lower surface recess 44*i* of the base plate 44 and the circumferential edge of the water inlet 2*b* of the flush toilet main body 2. Note that in the present embodiment, the packing 48 is a face seal that is crushed in a direction of a center axis of the discharge port 26*a* of the flush water tank 26 for sealing.

Here, the packing 48 is compressed by fixing the flush water tank 26 to the flush toilet main body 2 at the two fixing points (fixing holes 44*c* and 44*d*). The fixing holes 44*c* and 44*d* are each disposed on both sides of the discharge port 26*a* in the longitudinal direction of the flush toilet main body 2, and are disposed so that a straight line connecting them passes through the discharge port 26*a* in a top view. This makes it possible to reliably compress the packing 48 disposed in a portion of the discharge port 26*a*, whereby the watertightness can be reliably ensured. In this way, the packing 48 is disposed between the flush toilet main body 2 and the flush water tank 26 to ensure the watertightness therebetween.

Next, an operation of the flush toilet apparatus 1 according to an embodiment of the present invention will be described with reference to FIGS. 1 and 3.

First, when a user operates a toilet flushing switch (not illustrated) provided in the remote controller 35*a*, a flushing command signal is transmitted to the controller 35. When receiving the flushing command signal, the controller 35 transmits a control signal to the rim spouting electromagnetic valve 34 of the valve unit 24 to cause the rim spouting electromagnetic valve 34 to open. This causes the flush water supplied from the waterworks to spout from the rim spout port 10 through the rim spouting electromagnetic valve 34, the vacuum breaker 40, and the rim conduit 12. The flush water that has been spouted from the rim spout port 10 forms a circulating flow on the waste receiving surface 18 of the bowl 6 and washes the waste receiving surface 18.

After an elapse of a predetermined time period since the rim spouting electromagnetic valve 34 has been opened, the controller 35 transmits a control signal to the toilet flushing motor 36*a*, and pulls up the discharge valve 36 by the toilet flushing motor 36*a*. This causes the discharge valve 36 to open, and the flush water stored in the flush water tank 26 flows into the water inlet 2*b* of the flush toilet main body 2 from the discharge port 26*a* of the flush water tank 26, and is spouted from the jet spout port 14 through the jet water conduit 16. A siphon phenomenon is induced in the water discharge trap pipe 8 by a water spout from the jet spout port 14, and the flush water and waste in the bowl 6 are drained through the water discharge trap pipe 8.

The controller 35 transmits a control signal to the tank water supply electromagnetic valve 32 of the valve unit 24 to cause the tank water supply electromagnetic valve 32 to open. Hereby, the flush water supplied from the waterworks is supplied into the flush water tank 26 through the tank water supply electromagnetic valve 32.

When the water level in the flush water tank 26 is lowered to a predetermined water level, the discharge port 26*a* is closed by the discharge valve 36 and the water spout from the jet spout port 14 is stopped. The rim spouting electromagnetic valve 34 is left open even after the discharge port 26*a* is closed, and the flush water supplied from the waterworks is spouted from the rim spout port 10. When the water level in the bowl 6 rises to the predetermined water level by the water spout from the rim spout port 10, and the refilling is completed, the controller 35 transmits a control signal to the rim spouting electromagnetic valve 34 of the valve unit 24 to cause the rim spouting electromagnetic valve 34 to close.

On the other hand, since the tank water supply electromagnetic valve 32 is open even after the discharge valve 36 is closed, the water level in the flush water tank 26 rises by the flush water that has flowed into the flush water tank 26. When the water level in the flush water tank 26 rises to the predetermined water storage level, the float switch 38 detects this fact and a detection signal is transmitted to the controller 35. When receiving the detection signal from the float switch 38, the controller 35 transmits a control signal to the tank water supply electromagnetic valve 32 to cause the tank water supply electromagnetic valve 32 to close. This completes water supply to the flush water tank 26 and completes one toilet flush.

According to the flush toilet apparatus 1 of an embodiment of the present invention, the water inlet 2*b* of the flush toilet main body 2 is provided at a position eccentric to one side with respect to the lengthwise center line C of the flush toilet main body 2 (FIG. 4), thereby making it possible to provide the water inlet 2*b* in the flush toilet main body 2 while avoiding the water discharge trap pipe 8 extending from the bowl 6. As a result, the water inlet 2*b* can be formed at a lower position, and the flush toilet apparatus 1 can achieve a low silhouette.

The straight line connecting the fixing holes 44*c* and 44*d* (FIG. 5) serving as two fixing points passes through the discharge port 26*a* (discharge opening 44*a*) in a top view, thereby making it possible to firmly define a position of the flush water tank 26 in the vicinity of the discharge port 26*a*. This can prevent the water leakage between the discharge port 26*a* (discharge opening 44*a*) of the flush water tank 26 and the water inlet 2*b* of the flush toilet main body 2. Furthermore, the two fixing holes 44*c* and 44*d* are each disposed on both sides of the discharge port 26*a* (discharge opening 44*a*) in the longitudinal direction of the flush toilet main body 2, and the fixing hole 44*d* on the rear side is located closer to the lengthwise center line of the flush toilet main body 2 than the center point of the discharge port 26*a*. This makes it possible to firmly fix the flush water tank 26 to the flush toilet main body 2, and to sufficiently resist a force that tends to knock down the flush water tank 26 in the longitudinal direction of the flush toilet main body 2.

According to the flush toilet apparatus 1 of the present embodiment, the packing 48 is disposed between the flush toilet main body 2 and the flush water tank 26, and the packing 48 is compressed by fixing the flush water tank 26 (FIG. 6). Therefore, the fixing holes 44*c* and 44*d* (FIG. 5) serving as the two fixing points are disposed so that the straight line connecting the two fixing points passes through the discharge port 26*a*, thereby making it possible to uniformly compress the packing 48, and to increase the watertightness between the flush toilet main body 2 and the flush water tank 26.

According to the flush toilet apparatus 1 of the present embodiment, the water inlet 2*b* of the flush toilet main body 2 is lower than the upper surface (rim upper surface) of the rim 20 of the flush toilet main body 2 (FIG. 4), thereby making it possible to achieve the low-silhouette flush toilet apparatus 1. Furthermore, the water inlet 2*b* of the flush toilet main body 2 is higher than the water level of the pooled water W in the bowl 6 of the flush toilet main body 2, thereby making it possible to prevent the water inlet 2*b* of the flush toilet main body 2 from being immersed in the water during a non-flushing period of the flush toilet apparatus 1, and to reduce the deterioration of the packing 48.

According to the flush toilet apparatus 1 of the present embodiment, the auxiliary fixing holes 44*e* and 44*f* (FIG. 5) serving as the auxiliary fixing points are provided on a side opposite to the water inlet 2*b* of the flush toilet main body 2 with respect to the lengthwise center line C of the flush toilet main body 2, thereby making it possible to sufficiently resist a force that tends to knock down the flush water tank 26 in the width direction, and to firmly fix the flush water tank 26.

According to the flush toilet apparatus 1 of the present embodiment, the auxiliary fixing hole 44*e* among the auxiliary fixing holes 44*e* and 44*f* is provided at a position higher than the water inlet 2*b* (FIG. 5), thereby making it possible to fix the flush water tank 26 at a higher position, to more strongly resist the force that tends to knock down the flush water tank 26 when the force acts on the upper portion of the flush water tank 26, and to firmly fix the flush water tank 26.

According to the flush toilet apparatus 1 of the present embodiment, the base plate 44 constituting a part of the flush water tank 26 is fixed to the flush toilet main body 2 via a plurality of fixing holes 44*c* and 44*d* and auxiliary fixing holes 44*e* and 44*f*, thereby making it possible to cause the base plate 44 to absorb position errors of the bolt holes 2*a* serving as the fixing points formed in the flush toilet main body 2, and to attach the flush water tank main body 42 in an appropriate position.

According to the flush toilet apparatus 1 of the present embodiment, the O ring 46 which is a radial sealing member is disposed between the flush water tank main body 42 and the base plate 44 (FIG. 6), thereby making it possible to ensure the watertightness between the flush water tank main body 42 and the base plate 44. The watertightness is ensured by the O ring 46, thereby making it possible to achieve the low-silhouette flush toilet apparatus 1 in which a seal portion is provided with a thinner thickness compared to the case where a face seal is disposed between the flush water tank main body 42 and the base plate 44.

According to the flush toilet apparatus 1 of the present embodiment, the flush water tank 26 is fixed by the fixing holes 44*c* and 44*d* of the base plate 44 provided on the water inlet 2*b* side of the flush toilet main body 2 and the auxiliary fixing holes 44*e* and 44*f* provided on a side opposite to the water inlet 2*b*, with respect to the water discharge trap pipe 8, thereby making it possible to firmly fix the flush water tank 26 with a good balance.

The embodiments of the present invention have been described above. However, various modifications may be made to the above-described embodiments. In particular, in the above-described embodiments, the flush water tank 26 includes the flush water tank main body 42 and the base plate 44, but the flush water tank 26 may be constituted of a single member.

REFERENCE SIGNS LIST

1 Flush toilet apparatus
2 Flush toilet main body
2*a* Bolt hole
2*b* Water inlet
4 Flush water supply device
6 Bowl
8 Water discharge trap pipe
8*a* Inlet
8*b* Ascending conduit
8*c* Descending conduit
8*d* Top portion
10 Rim spout port
12 Rim conduit
14 Jet spout port
16 Jet water conduit
16*a* Upstream flow path
16*b* Bending flow path
16*c* Downstream flow path
18 Waste receiving surface
20 Rim
21 Shelf
22 Well portion
24 Valve unit
26 Flush water tank
26*a* Discharge port
26*b* Hose connection portion
28 Stop cock
28*a* Waterworks conduit
30 Fixed flow valve
32 Tank water supply electromagnetic valve
34 Rim spouting electromagnetic valve
35 Controller
35*a* Remote controller
36 Discharge valve
36*a* Toilet flushing motor
38 Float switch
40 Vacuum breaker
42 Flush water tank main body
44 Base plate
44*a* Discharge opening
44*b* Cutout portion

44*c*, 44*d* Fixing hole (fixing point)
44*e*, 44*f* Auxiliary fixing hole (auxiliary fixing point)
44*g* Cylindrical portion
44*h* Upper surface recess
44*i* Lower surface recess
44*j* Tank fixing portion
44*k* Tank fixing portion
46 O ring (radial sealing member)
48 Packing
50 Bolt

What is claimed is:

1. A flush toilet apparatus for flushing with flush water stored in a flush water tank, the flush toilet apparatus comprising:

a flush toilet main body that includes a bowl and a water discharge trap pipe extending from the bowl; and a flush water tank that is fixed to a rear portion of the flush toilet main body via at least two fixing points and drains the stored flush water from a discharge port to cause the flush water to flow into a water inlet of the flush toilet main body, wherein the water inlet of the flush toilet main body is provided at a position eccentric to one side with respect to a lengthwise center line of the flush toilet main body, wherein two fixing points among the fixing points are each disposed on both sides of the discharge port in a longitudinal direction of the flush toilet main body, and are disposed so that a straight line connecting the two fixing points passes through the discharge port in a top view, and wherein the fixing point located on a rear side among the two fixing points is located closer to the lengthwise center line of the flush toilet main body than a center point of the discharge port.

2. The flush toilet apparatus according to claim 1 further comprising a packing for ensuring watertightness between the flush toilet main body and the flush water tank, wherein the packing is disposed between the flush toilet main body and the flush water tank, and is compressed by fixing the flush water tank to the flush toilet main body at the two fixing points.

3. The flush toilet apparatus according to claim 1, wherein the water inlet of the flush toilet main body is provided at a position lower than a rim upper surface of the flush toilet main body and higher than a pooled water level in the bowl of the flush toilet main body.

4. The flush toilet apparatus according to claim 1, wherein at least one auxiliary fixing point for fixing the flush water tank to the flush toilet main body is further provided on a side opposite to the water inlet of the flush toilet main body with respect to the lengthwise center line of the flush toilet main body.

5. The flush toilet apparatus according to claim 4, wherein at least two of the auxiliary fixing points are provided, and at least one of the auxiliary fixing points are provided at a position higher than the water inlet.

6. The flush toilet apparatus according to claim 4, wherein the flush water tank includes a flush water tank main body and a base plate, and the base plate is fixed to the flush toilet main body via the plurality of fixing points and auxiliary fixing points.

7. The flush toilet apparatus according to claim 6, further comprising a radial sealing member disposed between the flush water tank main body and the base plate, the radial sealing member making it possible to ensure watertightness between the flush water tank main body and the base plate.

8. The flush toilet apparatus according to claim 4, wherein the water discharge trap pipe extends from the bowl to below the flush water tank, and the auxiliary fixing points are located on an opposite side of the water inlet of the flush toilet main body with respect to the water discharge trap pipe.

* * * * *